US012018853B2

(12) United States Patent
Wang et al.

(10) Patent No.: US 12,018,853 B2
(45) Date of Patent: Jun. 25, 2024

(54) SMART VENTILATION FOR AIR QUALITY CONTROL

(71) Applicant: International Business Machines Corporation, Armonk, NY (US)

(72) Inventors: Xinlin Wang, Irvine, CA (US); Ana C Biazetti, Cary, NC (US)

(73) Assignee: International Business Machines Corporation, Armonk, NY (US)

( * ) Notice: Subject to any disclaimer, the term of this patent is extended or adjusted under 35 U.S.C. 154(b) by 77 days.

(21) Appl. No.: 17/218,386

(22) Filed: Mar. 31, 2021

(65) Prior Publication Data

US 2022/0316737 A1 Oct. 6, 2022

(51) Int. Cl.

| | |
|---|---|
| ***F24F 11/63*** | (2018.01) |
| ***F24F 5/00*** | (2006.01) |
| ***F24F 11/47*** | (2018.01) |
| ***F24F 11/52*** | (2018.01) |
| ***F24F 11/58*** | (2018.01) |
| *F24F 140/60* | (2018.01) |

(52) U.S. Cl.

CPC ..... *F24F 11/63* (2018.01); *F24F 5/0046* (2013.01); *F24F 11/47* (2018.01); *F24F 11/52* (2018.01); *F24F 11/58* (2018.01); *F24F 2005/0064* (2013.01); *F24F 2140/60* (2018.01)

(58) Field of Classification Search

CPC ..... F24F 11/63; F24F 5/0046; F24F 11/47; F24F 11/52; F24F 11/58; F24F 2005/0064; F24F 2140/60

See application file for complete search history.

(56) References Cited

U.S. PATENT DOCUMENTS

| | | | | |
|---|---|---|---|---|
| 8,219,249 | B2 | 7/2012 | Harrod | |
| 10,179,542 | B1 * | 1/2019 | Salter | G08B 5/38 |
| 10,281,166 | B1 * | 5/2019 | Hutz | H04L 12/2825 |
| 10,458,668 | B2 | 10/2019 | Emmons | |
| 10,828,959 | B2 * | 11/2020 | Duan | B60H 3/00 |
| 2015/0052975 | A1 * | 2/2015 | Martin | F24F 11/62 73/31.02 |
| 2015/0151607 | A1 * | 6/2015 | Weber | B60Q 3/20 454/152 |

(Continued)

FOREIGN PATENT DOCUMENTS

WO 2020202236 A1 10/2020

OTHER PUBLICATIONS

김현주, "Air vent for vehicle" (Espacenet Machine Translation), Jul. 29, 2013, Espacenet translation (Year: 2013).*

(Continued)

*Primary Examiner* — Christopher W Carter

(74) *Attorney, Agent, or Firm* — Haley J. McClory

(57) ABSTRACT

A processor may control air quality in an enclosed space. A processor may receive an external air condition index dataset associated with a geographical location. A processor may receive an internal air condition index dataset from one or more data collection devices in the enclosed space. A processor may apply an optimization criteria to the external air condition index dataset and the internal air condition index dataset. A processor may, responsive to applying the optimization criteria, determine an air exchange plan. The processor may perform the air exchange plan.

18 Claims, 5 Drawing Sheets

(56) References Cited

U.S. PATENT DOCUMENTS

| | | | | |
|---|---|---|---|---|
| 2016/0318368 | A1* | 11/2016 | Alger | G08G 1/096725 |
| 2016/0377306 | A1* | 12/2016 | Drees | F24F 11/58 700/295 |
| 2017/0154517 | A1 | 6/2017 | Aliakseyeu | |
| 2020/0207263 | A1* | 7/2020 | Kim | B60Q 3/85 |
| 2020/0240668 | A1* | 7/2020 | Bassa | G05B 13/028 |

OTHER PUBLICATIONS

Anonymous. "Acool: Smart Ventilation System for Cars." Printed Mar. 31, 2021. 31 pages. Published by Indiegogo. https://www.indiegogo.com/projects/acool-smart-ventilation-system-for-cars#/.

Anonymous. "Awair Home." Printed Feb. 24, 2021. 2 pages. Published by Awair. https://www.getawair.com/home.

Anonymous. "Awair's Wildfire Smoke Guide." 5 pages. Published by Awair. https://blog.getawair.com/hubfs/Awair%20Wildfire%20Smoke%20Guide.pdf.

Anonymous. "PurpleAir: Real-time Air Quality Monitoring." Printed Feb. 24, 2021. 4 pages. Published by Purple Air. https://www2.purpleair.com/.

De Gids, et al., "VIP 32: Hybrid Ventilation." Published Jul. 2010. 8 pages. Published by AIVC. https://www.aivc.org/resource/vip-32-hybrid-ventilation?volume=33977.

Guyot, et al., "Smart ventilation energy and indoor air quality performance in residential buildings: a review." Published Apr. 15, 2018. 32 pages. In Energy and Buildings vol. 165. pp. 416-430. Published by Elsevier. https://www.sciencedirect.com/science/article/abs/pii/S0378778817324027.

Mazumdar, "Keeping data centers safe from air pollution." Published Jun. 27, 2018. Printed Feb. 24, 2021. 4 pages. Published by Smart World. https://smart.electronicsforu.com/data-center-air-pollution/.

Mell, et al., "The NIST Definition of Cloud Computing," Recommendations of the National Institute of Standards and Technology, U.S. Department of Commerce, Special Publication 800-145, Sep. 2011, 7 pgs.

Morton, "Operable Windows Deliver a Breath of Fresh Air." Published Mar. 20, 2015. Printed Feb. 24, 2021. 4 pages. Published by Buildings. https://www.buildings.com/articles/29704/operable-windows-deliver-breath-fresh-air.

Popa, "This Smart Car Ventilation System Promises Healthy Air Inside." Published Aug. 17, 2020. Printed Feb. 24, 2021. 6 pages. Published by Auto Evolution. https://www.autoevolution.com/news/this-smart-car-ventilation-system-promises-healthy-air-inside-147503.html.

* cited by examiner

SMART VENTILATION FOR AIR QUALITY CONTROL

BACKGROUND

The present disclosure relates generally to the field of air quality, and more particularly to techniques for controlling air quality.

Conversations about air pollutants and their effect on air quality often revolve around discussions of outdoor pollutants. While air pollutants associated with the environment and outdoors are important to consider, indoor pollutants and the need to ventilate enclosed structures to minimize negative effects associate with those indoor pollutants are also of concern. In some situations, the air quality in an enclosed structure can be worse than the air quality outside.

SUMMARY

Embodiments of the present disclosure include a method, computer program product, and system for controlling air quality in an enclosed space. A processor may receive an external air condition index dataset associated with a geographical location. A processor may receive an internal air condition index dataset from one or more data collection devices in the enclosed space. A processor may apply an optimization criteria to the external air condition index dataset and the internal air condition index dataset. A processor may, responsive to applying the optimization criteria, determine an air exchange plan. The processor may perform the air exchange plan.

The above summary is not intended to describe each illustrated embodiment or every implementation of the present disclosure.

BRIEF DESCRIPTION OF THE DRAWINGS

The drawings included in the present disclosure are incorporated into, and form part of, the specification. They illustrate embodiments of the present disclosure and, along with the description, serve to explain the principles of the disclosure. The drawings are only illustrative of certain embodiments and do not limit the disclosure.

Figure 1:
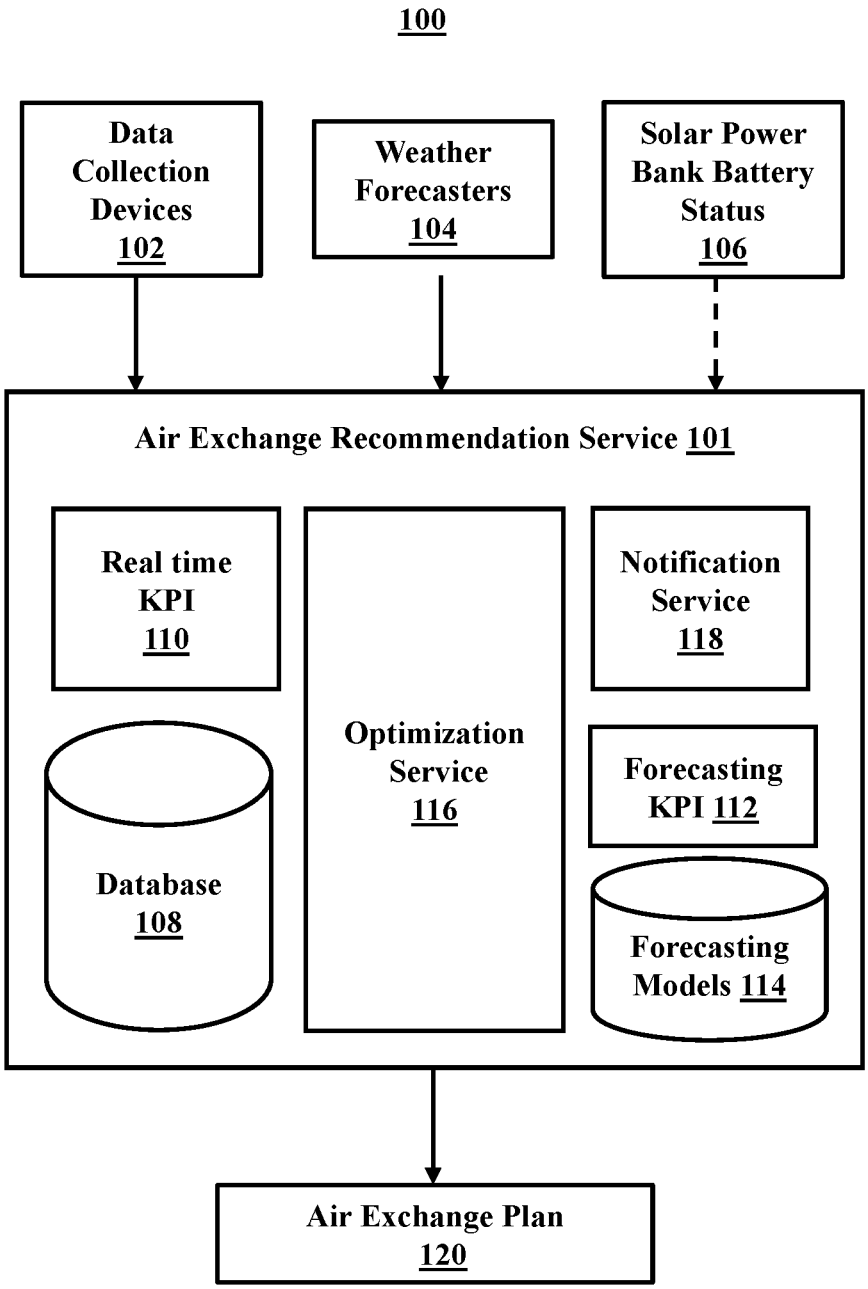
FIG. 1 illustrates a block diagram of a system for controlling air conditions in enclosed places, in accordance with embodiments of the present disclosure.

While the embodiments described herein are amenable to various modifications and alternative forms, specifics thereof have been shown by way of example in the drawings and will be described in detail. It should be understood, however, that the particular embodiments described are not to be taken in a limiting sense. On the contrary, the intention is to cover all modifications, equivalents, and alternatives falling within the spirit and scope of the disclosure.

DETAILED DESCRIPTION

The present disclosure relates generally to the field of air quality, and more particularly to techniques for controlling air exchange in enclosed spaces, based at least in part on air conditions. While the present disclosure is not necessarily limited to such applications, various aspects of the disclosure may be appreciated through a discussion of various examples using this context.

Air conditions (e.g., temperature, air quality index (AQI), humidity, etc.) associated with a particular geographical location (e.g., outdoor air conditions) can change dramatically within a day, fluctuating from high quality air conditions to low quality air conditions. Those unknowingly breathing low quality air can face serious health consequences, particularly if the air contains toxic pollutants. As such, it is important to consider external air quality (e.g., outdoor air conditions) as well as the air conditions of an enclosed space (e.g., indoor/enclosed space). While in some situations, the air in an enclosed space has higher quality air than the outdoor air, in other situations the opposite may be true. One traditional method of exchanging air between an enclosed space and the outdoors is through ventilation.

Ventilation controls internal air conditions by generating an air exchange between outdoors and the enclosed space. This air exchange may dilute and displace pollutants as well as, control the temperature, humidity, and air flow. While various types of ventilation presently exist, such methods can be generally categorized as either natural ventilation or mixed-mode ventilation. Natural ventilation is typically understood to refer to methods that allow for the intentional passive flow of outdoor air into an enclosed area (e.g., building, house, vehicle, etc.) through one or more planned opening (e.g., doors, windows, etc.). Natural ventilation generally relies on diffusive physical phenomena (e.g., air pressure, stack effect). For example, opening a window in the morning to let new/fresh outdoor air into the house. Unfortunately, because natural ventilation depends on environmental conditions, such systems may not provide the appropriate amount of ventilation. As such, a mixed-mode ventilation system may be implemented.

Mixed-mode ventilation may be typically understood to refer to methods that utilize both natural diffusive phenomena as well as mechanical means to promote ventilation. For example, a motor may be implemented to draw air into an enclosed space. Mixed-mode ventilation systems can use natural and mechanical means simultaneously or at different times. For example, a mixed mode ventilation system could be configured to use natural ventilation during the night and mechanical ventilation during the day or may operate differently depending on the season.

While both methods may effectively provide ventilation and air exchange between the outside and an enclosed space, such an air exchange is usually only effective when the outside air has a higher quality than the air inside the enclosed space. In situations where the outside air conditions are lower than the air conditions of the enclosed space, traditional methods of ventilation may not only be ineffective in dispelling/diluting pollutants, but may also result in wasted power consumption, particularly in situations where mechanical means of ventilation are utilized.

While in some situations people can monitor the AQI through weather websites or applications and decide independently when they should manually open a window, such methods are often not sustainable and could result in human error (e.g., opening the window at the wrong time). Enclosed spaces configured to have HVAC systems, can have air filters designed to minimize the amount and number of particular pollutants that enter an enclosed space during mixed-mode ventilation. However, these systems may still import polluted air into the enclosed space and require significant energy to function.

In embodiments discussed herein, are solutions provided in the form of a method, system, and computer program product for controlling air conditions in an enclosed space and, more particularly, for optimizing targeted air condition. Embodiments contemplated herein leverage air conditions sensor technology and other techniques (e.g., statistical analysis, artificial intelligence (AI), and/or machine learning) to consider real-time data (e.g., air quality index (AQI)), and future predicted air conditions (e.g., air conditions 6-8 hours in the future), based off of historical data, to optimize and efficiently exchange air between an enclosed space and the outside environment while minimizing energy waste.

In embodiments, a processor may receive or collect an external air condition index dataset associated with a geographical location. In these embodiments, a geographical location may include any location the enclosed space might occupy. For example, while in some embodiments a geographical location could include the external and surrounding environment of a house or office building, in other embodiments, the geographical location may include the route of a public bus as it travels throughout the day. In embodiments, the processor may receive an external air condition index dataset from one or more different data sources. These data sources may include, but are not limited to, one or more data collection devices (e.g., Internet of Things (IoT) sensor devices and/or weather imaging satellites), historical databases (e.g., weather database) associated with air conditions and/or the weather in the geographical location, and various forecasting models (e.g., air quality/conditions or weather forecasting models).

In embodiments, air condition IoT sensors (e.g., data collection devices) may be used to record one or more key performance indicators (KPI) associated with particular geographical location. A KPI may include, but is not limited to air temperature, humidity and moisture in the air, dust level (e.g., particulate size and amount), pollutant type and concentrations (e.g., high levels of carbon dioxide), or any combination thereof. In these embodiments, such data/information may be collected in real-time and stored in a historical database. In some embodiments, data/information may be utilized from a weather database and/or real-time data feeds to determine the air pollution index (API) associated with the geographical location of the enclosed space of interest. In some embodiments, a processor may collect data/information associated with the external air condition index dataset (e.g., APIs) from one or more third party vendors, such as The Weather Channel®. In embodiments, a processor can analyze the received APIs and derive KPIs associated with the outside environment of the enclosed space. In such embodiments, KPIs of a geographical location may be collected based on the zip code or GPS location of the enclosed space. While in embodiments where the enclosed space is mobile a vehicle) the geographical location may be continuously collected and updated via a GPS device, in other embodiments, a planned expected route (e.g., a bus route used for public transportation) may be used to determine what APIs should be used in the external air condition index dataset.

In embodiments, a processor may collect or receive an internal air condition index dataset. The processor may receive the internal air condition index dataset via one or more data collection devices (e.g., IoT sensor devices) configured in the enclosed space. The internal air condition index dataset may include real-time data/information associated with internal air conditions of the enclosed space and/or historical data/information associated with the historical condition of the internal air conditions. In embodiments, as data/information associated with the internal air condition index dataset is collected, it may be stored in a historical database and may be accessed later by the processor. In an example embodiment, a processor may receive an internal air condition index dataset that includes not only the current (e.g., real time) air condition data/information (e.g., temperature, humidity, pollutant particulate size, type of pollutants in the air, and/or concentrations of the pollutants) as well as how the air quality/condition data/information fluctuate over time. For example, the air quality/condition data/information may fluctuate depending on the season/time of year, particular weather patterns (e.g., hurricane or heatwave) and/or environmental events, such as large uncontrolled wildfires.

In embodiments, a processor may further analyze the external air condition index dataset and the internal air condition index dataset. In these embodiments, the processor may analyze the external air condition index dataset and the internal air condition index dataset to evaluate the risk that could occur during a particular time interval. Such an evaluation may determine the risk associated with negative effects that may occur if air is exchanged between the enclosed space and the outside space of the geographical location. In such embodiments, a processor may configure a risk index associated with this risk evaluation over a particular time interval.

In embodiments, a processor may use this risk evaluation/analysis to generate a forecast or to predict various air condition factors, such as those contemplated herein, of the particular geographical location. In some embodiments, the risk evaluation/analysis may be based, at least in part, on the internal and external air condition index datasets. In these embodiments, the internal and external air condition index datasets may be configured based, at least in part, on forecasted or predicted air conditions (e.g., forecasted or predicted air condition index). For example, a processor could be configured to calculate a current risk index, a risk index one hour from now, two hours from now and so on. While the aforementioned example provides an illustration of a risk evaluation in one-hour increments, any time interval may be used (e.g., every 15 minutes or 30 minutes).

As contemplated herein, a processor may base the risk evaluation on the internal air condition index dataset and external air condition index dataset. More particularly, the risk evaluation may include, but is not limited to evaluating the following: i) the AQI of the enclosed space and the AQI of the geographical environment outside the enclosed space; ii) the temperature difference between the enclosed space and the geographical environment; iii) humidity difference between the enclosed space and the geographical environment; or any combination thereof. In some embodiments, internal air condition index datasets may further include user configurable settings. For example, in some embodiments, a user could indicate a preferred temperature or humidity, or, due to a health issue (e.g., Asthma or other breathing issues) could require a higher AQI. In embodiments, internal air condition index datasets may also include HVAC system configurations. In these embodiments, a processor may collect data/information about the HVAC system. For example, a processor could be configured to collect/receive data/information regarding the efficiency, power consumption, and ventilation capabilities of the HVAC system associated with the enclosed space. HVAC systems and their ventilation capabilities may be impacted differently based on the characteristics of the outside air of the geographical location. For example, a significant temperature difference between the air in the enclosed space and the outdoor environment of the geographical location may impact the efficiency of the HVAC system.

In embodiments, a processor may apply an optimization criteria to the external air condition index dataset and the internal air condition index dataset to optimize and determine the optimized future air conditions (e.g., the optimized time for air exchange). In embodiments, external and internal air condition index datasets may include datasets having forecast KPI values associated with outside air and inside the enclosure air. In one example embodiment, at 7:00 am in the morning, a processor may forecast that in one hour (i.e., 8:00 am) the external air condition will have a AQI of 140, a temperature of 70° F., and the weather cloudy. Continuing this example embodiment, the processor may also forecast that in two hours (i.e., 9:00 am), the external air condition will have an AQI of 130, a temperature of 75° F., and the weather is cloudy with a chance of rain. In these embodiments, a processor may also forecast that in three hours (i.e., 10:00 am) the external air condition will have an AQI of 90, a temperature of 78° F., and the weather is sunny without cloud cover. The processor may use these future air conditions (e.g., air conditions at 8:00 am, 9:00 am, and 10:00 am) to optimization these intervals and generate an air exchange plan (e.g., opening a window at 10:00 am). In some embodiments, a processor may apply the risk index, based on the evaluation/analysis of the external air condition index dataset and the internal air condition index dataset, to the optimization criteria. In embodiments, an optimization criteria may include, but is not limited to, identifying an acceptable AQI, low energy consumption, and, in enclosed spaces configured to receive solar power, efficient use of solar batteries (e.g., power bank usage efficiency associated with a solar power system). In these embodiments a processor may apply the optimization criteria to the internal air condition index dataset and the external dataset and using optimization software (e.g., CPLEX®) can determine and/or generate an air exchange plan.

An air exchange plan may include a recommendation for the optimal time and/or method of ventilation or air exchange (e.g., natural ventilation or mix-mode ventilation) between an enclosed space and the outside environment of the geographical location, while ensuring a sufficiently low AQI and minimizing energy consumption/increasing energy efficiency (e.g., reducing the number of times a solar battery may have to charge or discharge). For example, an air exchange plan could recommend opening a window between 7:00 am and 9:00 am, and/or using a HVAC system every hour for 15 minutes between the hours of 12:00 pm and 5:00 pm. In some embodiments, a processor may select an air exchange plan from a set of air exchange plans. In these embodiments, a processor may access a database having a set of air exchange plans that may be previously configured to address particular risk indexes and/or optimization criteria.

In embodiments, a processor may perform the air exchange plan. In embodiments, performing an air exchange plan may include activating or sending a notification. In some embodiments a notification could include sending a notification message, such as a text message, email, or notification message to a mobile application, to a user. In one example embodiment, a user could live in a house (e.g., enclosed space) with an outdated HVAC system or portable air-conditioning system. In this example, the house could be in a geographical location where, due to nearby environmental conditions (e.g., forest wildfire) the AQI is very high. However, due to shifts in the direction of the wind, the AQI shifts from a low level to a sufficient level. The user could receive a notification message from a processor on his mobile phone recommending an air exchange plan. This notification message could recommend the optimal time and/or method a user should ventilate his house. Continuing this example, the notification message could recommend the user open his window or turn on his portable air-conditioner at a particular time when the AQI is 50 and temperature is 80° for one hour and then close the window for the next 5 hours when AQI for his geographical area exceeds 100 and temperature exceeds 89° F.

In another example embodiment, the user could have a solar panel system installed on the roof of his house to mitigate energy costs. Often solar panel systems have batteries configured to save solar power that cannot be immediately consumed. Using embodiments contemplated herein, a processor may receive or collect the solar battery status. This information/data may be included in the internal air condition index dataset and evaluated during the optimization process with the optimization criteria (e.g., power consumption efficiency). In such embodiments, the air exchange plan may include consuming the solar energy more or less without continuously charging and discharging the solar battery. Because the life expectancy of a solar battery is mostly determined by its usage cycles, such embodiments may increase the life of a solar battery by reducing the number of discharge/recharge cycles that occur as a result of air exchange.

In some embodiments, a processor may perform an air exchange plan by sending a notification to the controller of a HVAC system. In these embodiments, the notification may activate the HVAC system to perform the air exchange at an optimal time. For example, at the optimal time (e.g., concerning targeted air conditions, power efficiency, and solar battery operating efficiency), a processor could send a notification that activates the HVAC system to perform air exchange for a particular amount of time. In these embodiments, the activating notification may include how long the ventilation should continue before the HVAC system should be turned off.

In some embodiments, the HVAC system could be configured within a vehicle, such as a car or bus (e.g., enclosed space). For example, a user could be traveling from San Diego to San Francisco in their car. Using methods and techniques contemplated herein, a processor could send a notification to the car's HVAC system to automatically switch between internal ventilation (e.g., recirculating air in the car) and external ventilation (e.g., air exchange/ventilation), based on the optimized air exchange plan using the current and future air conditions (e.g., external and internal air condition index dataset). As discussed herein the optimization and may be based, not only air condition factors (e.g., temperature and humidity differences between inside and outside of the car), but also power consumption and energy efficiency. Such embodiments may allow the user to enjoyed high quality air conditions inside the car throughout the duration of the road trip. In addition, the car will burn less gas to operate the car's HVAC system (e.g., air-conditioner).

In some embodiments, such as those where the enclosed space may be occupied by more than one user or is a public area, a processor may perform the air exchange plan by sending a notification to activate an indicator light. In embodiments, the indicator light may indicate that whether it is an optimal time for air exchange. For example, in office buildings or on a bus, an indicator light may be positioned by a window or fan. If the processor determines that it is an optimal time for air exchange, the indicator light may turn on or be a specific color (e.g., green). But, if the processor determines that it is not an optimal time for air exchange, the light may turn off or change a different color (e.g., red). Such embodiments may reduce conflict caused by differences in personal preferences by clearly indicating whether it is beneficial to open a window to ventilate the enclosed space.

Referring now to FIG. 1, a block diagram of a system 100 for controlling air exchange in an enclosed space, is depicted in accordance with embodiments of the present disclosure. FIG. 1 provides an illustration of only one implementation and does not imply any limitations with regard to the environments in which different embodiments may be implemented. Many modifications to the depicted environment may be made by those skilled in the art without departing from the scope of the invention as recited by the claims.

In embodiments, system 100 include air exchange recommendation service 101. In embodiments, air exchange recommendation service 101 may recommend one or more air exchange plans that may provide an ideal targeted indoor air condition (e.g., air conditions of an enclosed space). For example, a targeted ideal air condition could be 70° F., a particular humidity level, and an AQI of 7. In these embodiments, air exchange recommendation service 101 may receive data/information from one or more data collection devices 102, weather forecasters 104, and, in enclosed spaces having solar panel systems, solar power bank battery status data 106. Data/information collected from data collection devices 102, weather forecasters 104, and/or solar power bank battery status data 106 may be compiled by air exchange recommendation service 101 into an internal air condition index dataset and an external air condition index dataset. In embodiments, as data/information (e.g., internal air condition index dataset and an external air condition index dataset) are collected and/or compiled, such data/information may be stored within database 108. In embodiments, data collection devices 102 may be configured to relay real-time data, such as real-time KPIs 110 pertaining to quality air conditions both inside and outside the enclosed space. While in some embodiments, machine learning may use the data/information stored within database 108 to generate one or more forecasts, in other embodiments, forecasts may be independently configured. These forecasts may include, but are not limited to, forecasting KPI values 112 (e.g., associated with risk evaluation/analysis and future risk indexes), and forecasting models 114 associated with determining how different factors, such as environmental situations (e.g., forest wildfire) or the weather (e.g., wind direction or heatwave), may affect air condition quality.

In embodiments, air exchange recommendation service 101 may further include optimization service 116. In some embodiments, optimization service 116 may utilize optimization software, such as CPLEX®. Optimization service 116 may be configured to apply one or more optimization criteria to the internal air condition index dataset and an external air condition index dataset. These optimization criteria may include, but are not limited to, obtaining a sufficient air conditions (e.g., low AQI, desired temperature, humidity), low power consumption, and for enclosed spaces configured with a solar panel system, long solar battery life (e.g., by minimizing number of battery charge/discharge cycles). Optimization service 116 may perform the optimization and determine one or more air exchange plans 120. As contemplated herein air exchange plans 120 may include the optimal time and/or method air exchange should occur for a particular enclosed space in a geographical location.

In embodiments, air exchange recommendation service 101 may further include notification service 118. In embodiments, notification service 118 may be configured to send, activate, or initiate one or more notifications to a user, to perform air exchange plan 120. In these embodiments, notification service 118 may be configured to send a notification message, such as a text message, email, or mobile phone application, that provides the air exchange plan to a user. In some embodiments, notification service 118 may be configured to control a HVAC system. In these embodiments, notification service 118 may control the HVAC system as dictated by air exchange plan 120. In other embodiments, notification service 118 may indicate via an indicator light, located proximate to a window or opening of an enclosed space, that it is or is not an optimal time for air exchange.

Figure 2:
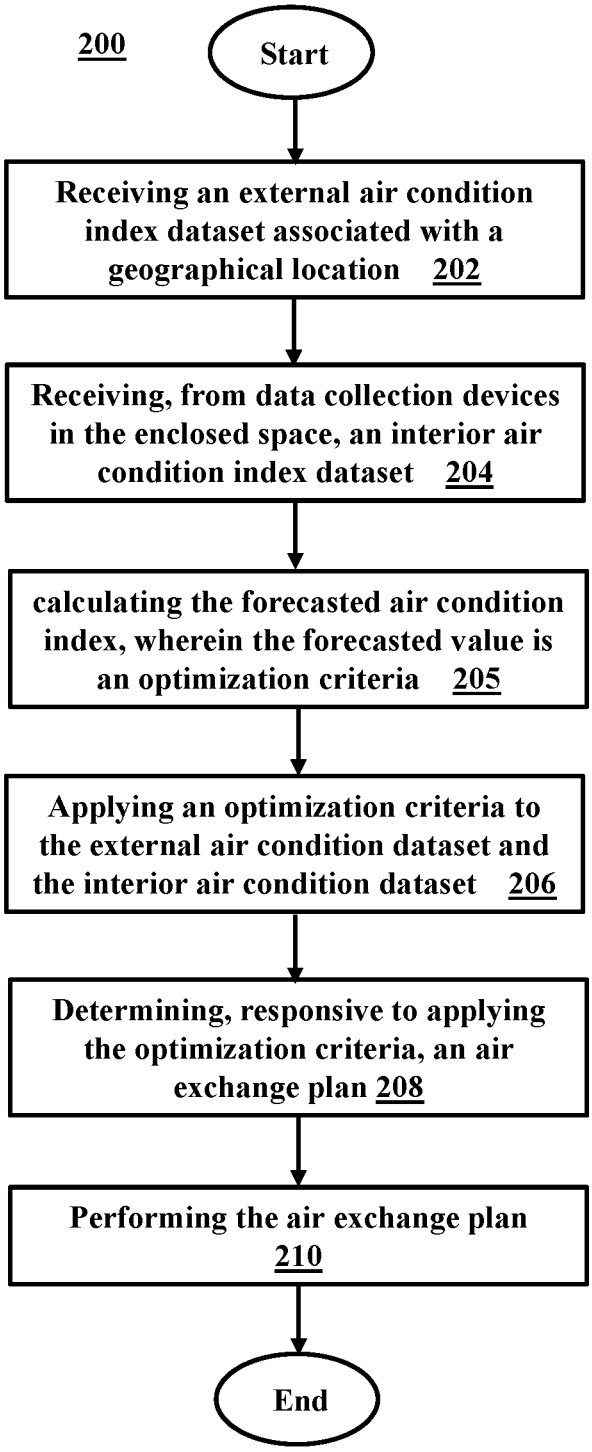
FIG. 2 illustrates a flowchart of a method controlling air conditions in enclosed places, in accordance with embodiments of the present disclosure.

Referring now to FIG. 2, a flowchart illustrating an example method 200 for controlling air conditions in an enclosed space, in accordance with embodiments of the present disclosure. In some embodiments, the method 200 begins at operation 202 where a processor receives an external air condition index dataset associated with a geographical location.

In some embodiments, the method 200 proceeds to operation 204. At operation 204, a processor may receive, from one or more data collection devices in the enclosed space, an internal air condition index dataset. For example, in some embodiments, data/information associated with internal air condition index datasets may also be received from a forecasting module, such as forecasting module 112 in FIG. 1.

In some embodiments, the method 200 proceeds to operation 205. At operation 205, a processor may calculate the forecasted air condition index (e.g., external and internal air condition index dataset). In some embodiments, the forecasted air condition index may be utilized during optimization.

In some embodiments, the method 200 proceeds to operation 206. At operation 206, the processor applying an optimization criteria to the external air condition index dataset and the internal air condition index dataset.

In some embodiments, the method 200 proceeds to operation 208. At operation 208, the processor may determine, responsive to applying the optimization criteria, an air exchange plan. In some embodiments, the method 200 proceeds to operation 210. At operation 210, the processor may perform the air exchange plan. In some embodiments, as depicted in FIG. 2, after operation 210, the method 200 may end.

As discussed in more detail herein, it is contemplated that some or all of the operations of the method 200 may be performed in alternative orders or may not be performed at all; furthermore, multiple operations may occur at the same time or as an internal part of a larger process.

It is to be understood that although this disclosure includes a detailed description on cloud computing, implementation of the teachings recited herein are not limited to a cloud computing environment. Rather, embodiments of the present disclosure are capable of being implemented in conjunction with any other type of computing environment now known or later developed.

Cloud computing is a model of service delivery for enabling convenient, on-demand network access to a shared pool of configurable computing resources (e.g., networks, network bandwidth, servers, processing, memory, storage, applications, virtual machines, and services) that can be rapidly provisioned and released with minimal management effort or interaction with a provider of the service. This cloud model may include at least five characteristics, at least three service models, and at least four deployment models.

Characteristics are as follows:

On-demand self-service: a cloud consumer can unilaterally provision computing capabilities, such as server time and network storage, as needed automatically without requiring human interaction with the service's provider.

Broad network access: capabilities are available over a network and accessed through standard mechanisms that promote use by heterogeneous thin or thick client platforms (e.g., mobile phones, laptops, and PDAs).

Resource pooling: the provider's computing resources are pooled to serve multiple consumers using a multi-tenant model, with different physical and virtual resources dynamically assigned and reassigned according to demand. There is a sense of portion independence in that the consumer generally has no control or knowledge over the exact portion of the provided resources but may be able to specify portion at a higher level of abstraction (e.g., country, state, or datacenter).

Rapid elasticity: capabilities can be rapidly and elastically provisioned, in some cases automatically, to quickly scale out and rapidly released to quickly scale in. To the consumer, the capabilities available for provisioning often appear to be unlimited and can be purchased in any quantity at any time.

Measured service: cloud systems automatically control and optimize resource use by leveraging a metering capability at some level of abstraction appropriate to the type of service (e.g., storage, processing, bandwidth, and active user accounts). Resource usage can be monitored, controlled, and reported, providing transparency for both the provider and consumer of the utilized service.

Service Models are as follows:

Software as a Service (SaaS): the capability provided to the consumer is to use the provider's applications running on a cloud infrastructure. The applications are accessible from various client devices through a thin client interface such as a web browser (e.g., web-based e-mail). The consumer does not manage or control the underlying cloud infrastructure including network, servers, operating systems, storage, or even individual application capabilities, with the possible exception of limited user-specific application configuration settings.

Platform as a Service (PaaS): the capability provided to the consumer is to deploy onto the cloud infrastructure consumer-created or acquired applications created using programming languages and tools supported by the provider. The consumer does not manage or control the underlying cloud infrastructure including networks, servers, operating systems, or storage, but has control over the deployed applications and possibly application hosting environment configurations.

Infrastructure as a Service (IaaS): the capability provided to the consumer is to provision processing, storage, networks, and other fundamental computing resources where the consumer is able to deploy and run arbitrary software, which can include operating systems and applications. The consumer does not manage or control the underlying cloud infrastructure but has control over operating systems, storage, deployed applications, and possibly limited control of select networking components (e.g., host firewalls).

Deployment Models are as follows:

Private cloud: the cloud infrastructure is operated solely for an organization. It may be managed by the organization or a third party and may exist on-premises or off-premises.

Community cloud: the cloud infrastructure is shared by several organizations and supports a specific community that has shared concerns (e.g., mission, security requirements, policy, and compliance considerations). It may be managed by the organizations or a third party and may exist on-premises or off-premises.

Public cloud: the cloud infrastructure is made available to the general public or a large industry group and is owned by an organization selling cloud services.

Hybrid cloud: the cloud infrastructure is a composition of two or more clouds (private, community, or public) that remain unique entities but are bound together by standardized or proprietary technology that enables data and application portability (e.g., cloud bursting for load-balancing between clouds).

A cloud computing environment is service oriented with a focus on statelessness, low coupling, modularity, and semantic interoperability. At the heart of cloud computing is an infrastructure that includes a network of interconnected nodes.

Figure 3A:
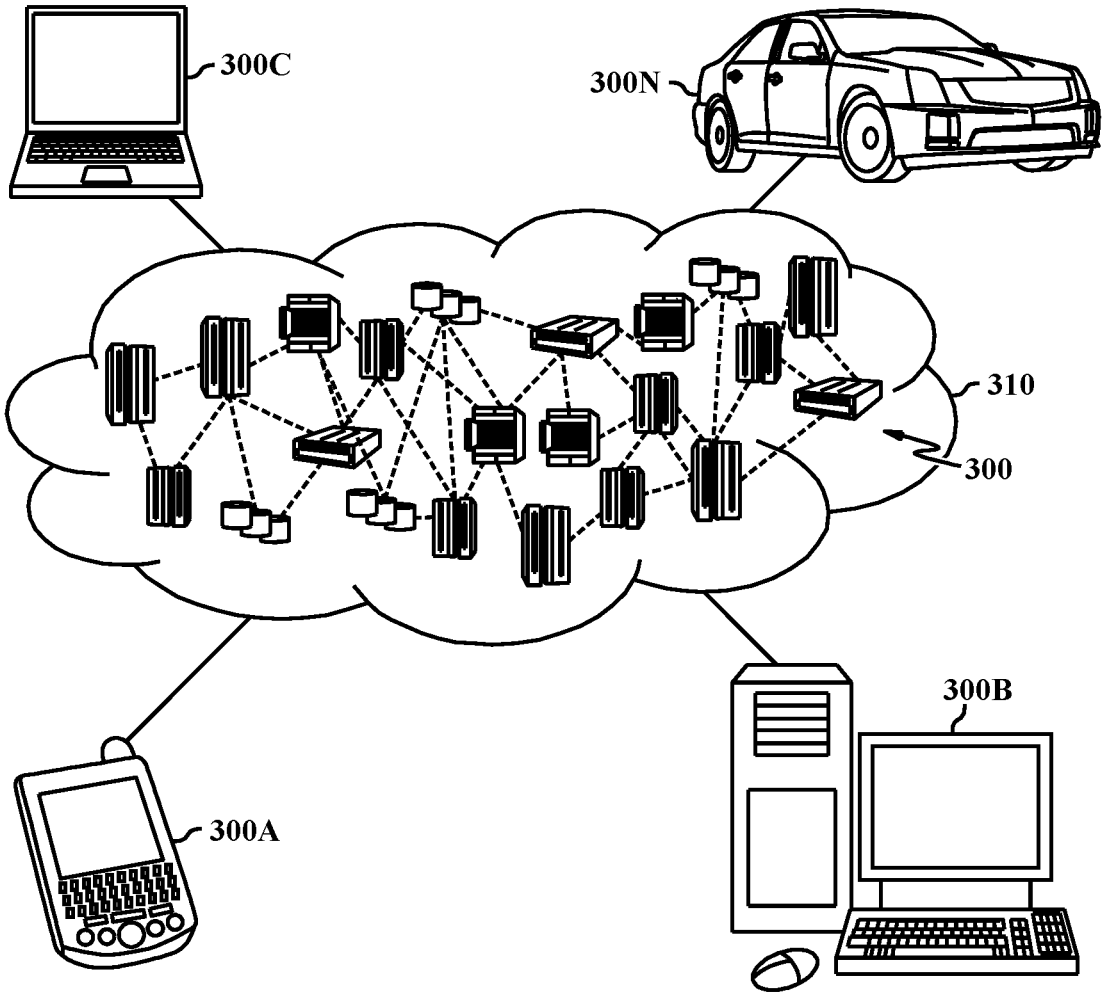
FIG. 3A illustrates a cloud computing environment, in accordance with embodiments of the present disclosure.

Referring now to FIG. 3A, illustrative cloud computing environment 310 is depicted. As shown, cloud computing environment 310 includes one or more cloud computing nodes 300 with which local computing devices used by cloud consumers, such as, for example, personal digital assistant (PDA) or cellular telephone 300A, desktop computer 300B, laptop computer 300C, and/or automobile computer system 300N may communicate. Nodes 300 may communicate with one another. They may be grouped (not shown) physically or virtually, in one or more networks, such as Private, Community, Public, or Hybrid clouds as described hereinabove, or a combination thereof. This allows cloud computing environment 310 to offer infrastructure, platforms and/or software as services for which a cloud consumer does not need to maintain resources on a local computing device. It is understood that the types of computing devices 300A-N shown in FIG. 3A are intended to be illustrative only and that computing nodes 300 and cloud computing 300 and cloud computing environment 310 can communicate with any type of computerized device over any type of network and/or network addressable connection (e.g., using a web browser).

Figure 3B:
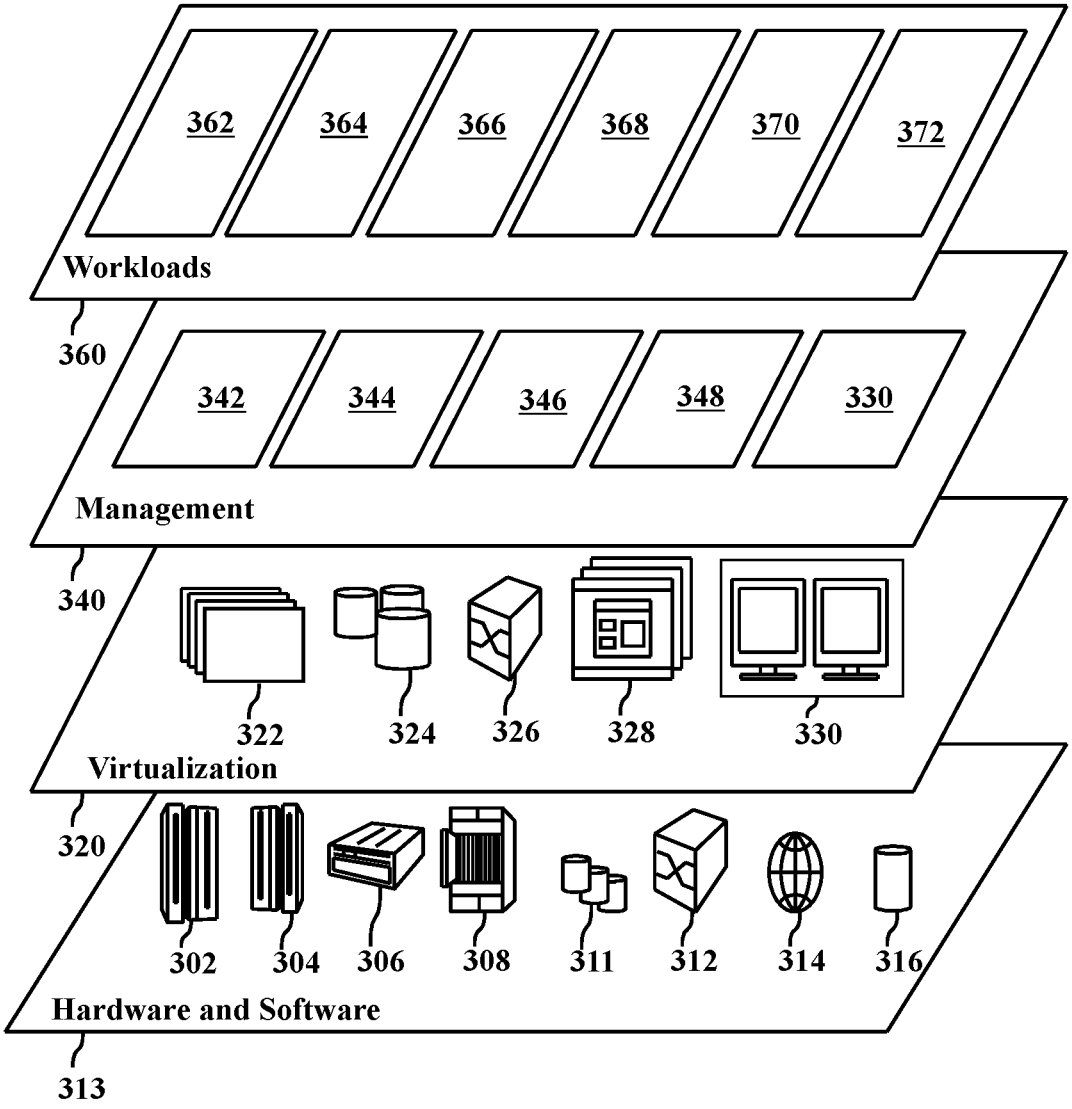
FIG. 3B illustrates abstraction model layers, in accordance with embodiments of the present disclosure.

Referring now to FIG. 3B, a set of functional abstraction layers provided by cloud computing environment 310 (FIG. 3A) is shown. It should be understood in advance that the components, layers, and functions shown in FIG. 3B are intended to be illustrative only and embodiments of the disclosure are not limited thereto. As depicted below, the following layers and corresponding functions are provided.

Hardware and software layer 315 includes hardware and software components. Examples of hardware components include: mainframes 302; RISC (Reduced Instruction Set Computer) architecture based servers 304; servers 306; blade servers 308; storage devices 311; and networks and networking components 312. In some embodiments, software components include network application server software 314 and database software 316.

Virtualization layer 320 provides an abstraction layer from which the following examples of virtual entities may be provided: virtual servers 322; virtual storage 324; virtual networks 326, including virtual private networks; virtual applications and operating systems 328; and virtual clients 330.

In one example, management layer 340 may provide the functions described below. Resource provisioning 342 provides dynamic procurement of computing resources and other resources that are utilized to perform tasks within the cloud computing environment. Metering and Pricing 344 provide cost tracking as resources are utilized within the cloud computing environment, and billing or invoicing for consumption of these resources. In one example, these resources may include application software licenses. Security provides identity verification for cloud consumers and tasks, as well as protection for data and other resources. User portal 346 provides access to the cloud computing environment for consumers and system administrators. Service level management 348 provides cloud computing resource allocation and management such that required service levels are met. Service Level Agreement (SLA) planning and fulfillment 350 provide pre-arrangement for, and procurement of, cloud computing resources for which a future requirement is anticipated in accordance with an SLA.

Workloads layer 360 provides examples of functionality for which the cloud computing environment may be utilized. Examples of workloads and functions which may be provided from this layer include: mapping and navigation 362; software development and lifecycle management 364; virtual classroom education delivery 366; data analytics processing 368; transaction processing 370; and controlling air conditions in enclosed places 372.

Figure 4:
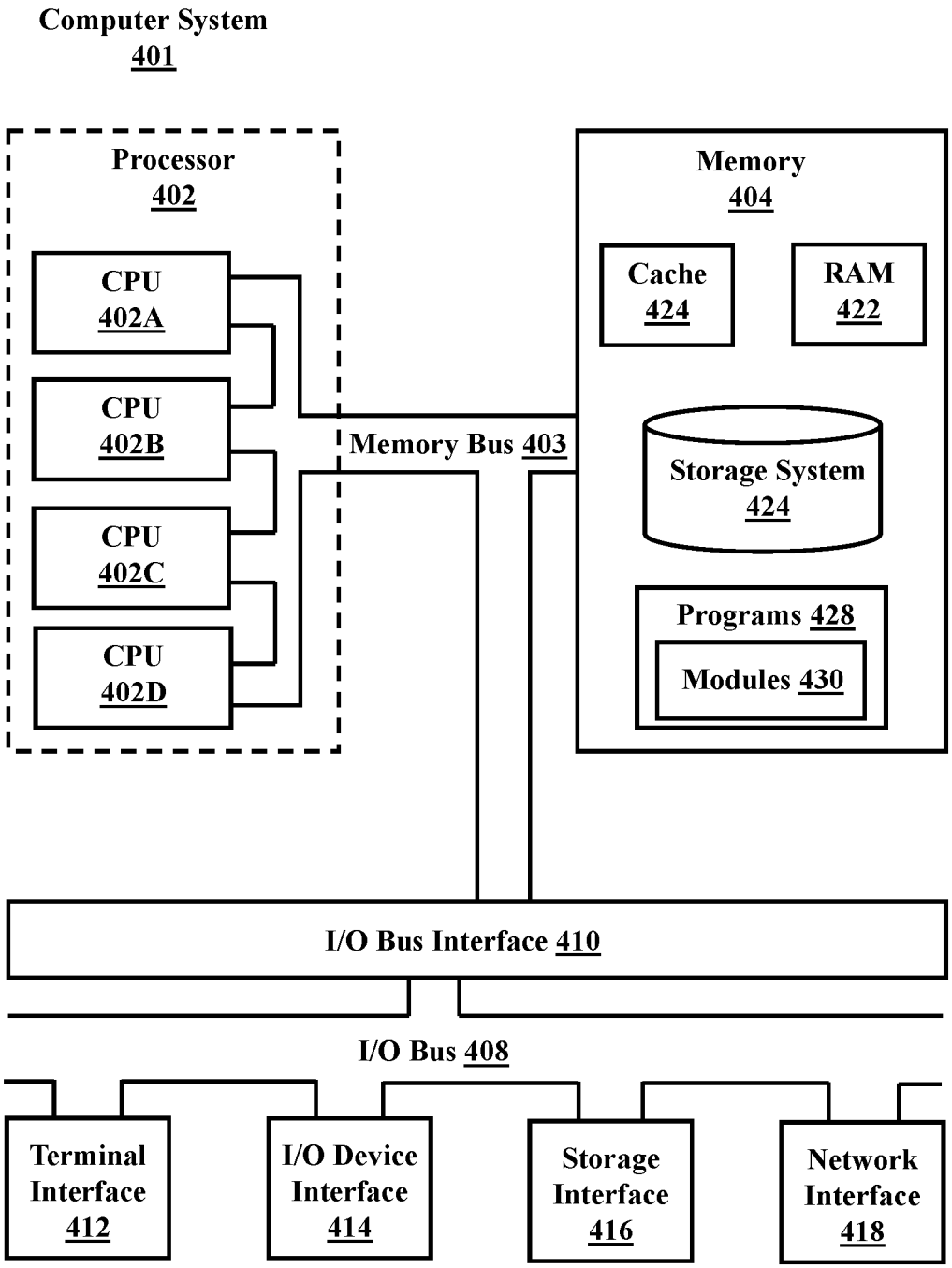
FIG. 4 illustrates a high-level block diagram of an example computer system that may be used in implementing one or more of the methods, tools, and modules, and any related functions, described herein, in accordance with embodiments of the present disclosure.

FIG. 4, illustrated is a high-level block diagram of an example computer system 401 that may be used in implementing one or more of the methods, tools, and modules, and any related functions, described herein (e.g., using one or more processor circuits or computer processors of the computer), in accordance with embodiments of the present invention. In some embodiments, the major components of the computer system 401 may comprise one or more Processor 402, a memory subsystem 404, a terminal interface 412, a storage interface 416, an I/O (Input/Output) device interface 414, and a network interface 418, all of which may be communicatively coupled, directly or indirectly, for inter-component communication via a memory bus 403, an I/O bus 408, and an I/O bus interface unit 410.

The computer system 401 may contain one or more general-purpose programmable central processing units (CPUs) 402A, 402B, 402C, and 402D, herein generically referred to as the CPU 402. In some embodiments, the computer system 401 may contain multiple processors typical of a relatively large system; however, in other embodiments the computer system 401 may alternatively be a single CPU system. Each CPU 402 may execute instructions stored in the memory subsystem 404 and may include one or more levels of on-board cache.

System memory 404 may include computer system readable media in the form of volatile memory, such as random access memory (RAM) 422 or cache memory 424. Computer system 401 may further include other removable/non-removable, volatile/non-volatile computer system storage media. By way of example only, storage system 426 can be provided for reading from and writing to a non-removable, non-volatile magnetic media, such as a "hard drive." Although not shown, a magnetic disk drive for reading from and writing to a removable, non-volatile magnetic disk (e.g., a "floppy disk"), or an optical disk drive for reading from or writing to a removable, non-volatile optical disc such as a CD-ROM, DVD-ROM or other optical media can be provided. In addition, memory 404 can include flash memory, e.g., a flash memory stick drive or a flash drive. Memory devices can be connected to memory bus 403 by one or more data media interfaces. The memory 404 may include at least one program product having a set (e.g., at least one) of program modules that are configured to carry out the functions of various embodiments.

One or more programs/utilities 428, each having at least one set of program modules 430 may be stored in memory 404. The programs/utilities 428 may include a hypervisor (also referred to as a virtual machine monitor), one or more operating systems, one or more application programs, other program modules, and program data. Each of the operating systems, one or more application programs, other program modules, and program data or some combination thereof, may include an implementation of a networking environment. Programs 428 and/or program modules 430 generally perform the functions or methodologies of various embodiments.

Although the memory bus 403 is shown in FIG. 4 as a single bus structure providing a direct communication path among the CPUs 402, the memory subsystem 404, and the I/O bus interface 410, the memory bus 403 may, in some embodiments, include multiple different buses or communication paths, which may be arranged in any of various forms, such as point-to-point links in hierarchical, star or web configurations, multiple hierarchical buses, parallel and redundant paths, or any other appropriate type of configuration. Furthermore, while the I/O bus interface 410 and the I/O bus 408 are shown as single respective units, the computer system 401 may, in some embodiments, contain multiple I/O bus interface units 410, multiple I/O buses 408, or both. Further, while multiple I/O interface units are shown, which separate the I/O bus 408 from various communications paths running to the various I/O devices, in other embodiments some or all of the I/O devices may be connected directly to one or more system I/O buses.

In some embodiments, the computer system 401 may be a multi-user mainframe computer system, a single-user system, or a server computer or similar device that has little or no direct user interface, but receives requests from other computer systems (clients). Further, in some embodiments, the computer system 401 may be implemented as a desktop computer, portable computer, laptop or notebook computer, tablet computer, pocket computer, telephone, smartphone, network switches or routers, or any other appropriate type of electronic device.

It is noted that FIG. 4 is intended to depict the representative major components of an exemplary computer system 401. In some embodiments, however, individual components may have greater or lesser complexity than as represented in FIG. 4, components other than or in addition to those shown in FIG. 4 may be present, and the number, type, and configuration of such components may vary.

As discussed in more detail herein, it is contemplated that some or all of the operations of some of the embodiments of methods described herein may be performed in alternative orders or may not be performed at all; furthermore, multiple operations may occur at the same time or as an internal part of a larger process.

The present invention may be a system, a method, and/or a computer program product at any possible technical detail level of integration. The computer program product may include a computer readable storage medium (or media) having computer readable program instructions thereon for causing a processor to carry out aspects of the present invention.

The computer readable storage medium can be a tangible device that can retain and store instructions for use by an instruction execution device. The computer readable storage medium may be, for example, but is not limited to, an electronic storage device, a magnetic storage device, an optical storage device, an electromagnetic storage device, a semiconductor storage device, or any suitable combination of the foregoing. A non-exhaustive list of more specific examples of the computer readable storage medium includes the following: a portable computer diskette, a hard disk, a random access memory (RAM), a read-only memory (ROM), an erasable programmable read-only memory (EPROM or Flash memory), a static random access memory (SRAM), a portable compact disc read-only memory (CD-ROM), a digital versatile disk (DVD), a memory stick, a floppy disk, a mechanically encoded device such as punch-cards or raised structures in a groove having instructions recorded thereon, and any suitable combination of the foregoing. A computer readable storage medium, as used herein, is not to be construed as being transitory signals per se, such as radio waves or other freely propagating electromagnetic waves, electromagnetic waves propagating through a waveguide or other transmission media (e.g., light pulses passing through a fiber-optic cable), or electrical signals transmitted through a wire.

Computer readable program instructions described herein can be downloaded to respective computing/processing devices from a computer readable storage medium or to an external computer or external storage device via a network, for example, the Internet, a local area network, a wide area network and/or a wireless network. The network may comprise copper transmission cables, optical transmission fibers, wireless transmission, routers, firewalls, switches, gateway computers and/or edge servers. A network adapter card or network interface in each computing/processing device receives computer readable program instructions from the network and forwards the computer readable program instructions for storage in a computer readable storage medium within the respective computing/processing device.

Computer readable program instructions for carrying out operations of the present invention may be assembler instructions, instruction-set-architecture (ISA) instructions, machine instructions, machine dependent instructions, microcode, firmware instructions, state-setting data, configuration data for integrated circuitry, or either source code or object code written in any combination of one or more programming languages, including an object oriented programming language such as Smalltalk, C++, or the like, and procedural programming languages, such as the "C" programming language or similar programming languages. The computer readable program instructions may execute entirely on the user's computer, partly on the user's computer, as a stand-alone software package, partly on the user's computer and partly on a remote computer or entirely on the remote computer or server. In the latter scenario, the remote computer may be connected to the user's computer through any type of network, including a local area network (LAN) or a wide area network (WAN), or the connection may be made to an external computer (for example, through the Internet using an Internet Service Provider). In some embodiments, electronic circuitry including, for example, programmable logic circuitry, field-programmable gate arrays (FPGA), or programmable logic arrays (PLA) may execute the computer readable program instructions by utilizing state information of the computer readable program instructions to personalize the electronic circuitry, in order to perform aspects of the present invention.

Aspects of the present invention are described herein with reference to flowchart illustrations and/or block diagrams of methods, apparatus (systems), and computer program products according to embodiments of the disclosure. It will be understood that each block of the flowchart illustrations and/or block diagrams, and combinations of blocks in the flowchart illustrations and/or block diagrams, can be implemented by computer readable program instructions.

These computer readable program instructions may be provided to a processor of a computer, or other programmable data processing apparatus to produce a machine, such that the instructions, which execute via the processor of the computer or other programmable data processing apparatus, create means for implementing the functions/acts specified in the flowchart and/or block diagram block or blocks. These computer readable program instructions may also be stored in a computer readable storage medium that can direct a computer, a programmable data processing apparatus, and/or other devices to function in a particular manner, such that the computer readable storage medium having instructions stored therein comprises an article of manufacture including instructions which implement aspects of the function/act specified in the flowchart and/or block diagram block or blocks.

The computer readable program instructions may also be loaded onto a computer, other programmable data processing apparatus, or other device to cause a series of operational steps to be performed on the computer, other programmable apparatus or other device to produce a computer implemented process, such that the instructions which execute on the computer, other programmable apparatus, or other device implement the functions/acts specified in the flowchart and/or block diagram block or blocks.

The flowchart and block diagrams in the Figures illustrate the architecture, functionality, and operation of possible implementations of systems, methods, and computer program products according to various embodiments of the present invention. In this regard, each block in the flowchart or block diagrams may represent a module, segment, or portion of instructions, which comprises one or more executable instructions for implementing the specified logical function(s). In some alternative implementations, the functions noted in the blocks may occur out of the order noted in the Figures. For example, two blocks shown in succession may, in fact, be accomplished as one step, executed concurrently, substantially concurrently, in a partially or wholly temporally overlapping manner, or the blocks may sometimes be executed in the reverse order, depending upon the functionality involved. It will also be noted that each block of the block diagrams and/or flowchart illustration, and combinations of blocks in the block diagrams and/or flowchart illustration, can be implemented by special purpose hardware-based systems that perform the specified functions or acts or carry out combinations of special purpose hardware and computer instructions.

The descriptions of the various embodiments of the present invention have been presented for purposes of illustration, but are not intended to be exhaustive or limited to the embodiments disclosed. Many modifications and variations will be apparent to those of ordinary skill in the art without departing from the scope and spirit of the described embodiments. The terminology used herein was chosen to best explain the principles of the embodiments, the practical application or technical improvement over technologies found in the marketplace, or to enable others of ordinary skill in the art to understand the embodiments disclosed herein.

Although the present invention has been described in terms of specific embodiments, it is anticipated that alterations and modification thereof will become apparent to the skilled in the art. Therefore, it is intended that the following claims be interpreted as covering all such alterations and modifications as fall within the true spirit and scope of the disclosure.

What is claimed is:

1. A method for controlling air conditions in an enclosed space of a vehicle, the method comprising:

receiving, by a processor, an external air condition index dataset associated with a geographical location;

receiving, from one or more data collection devices in the enclosed space, an internal air condition index dataset, wherein the enclosed spaces has one or more indicator lights, associated with each of one or more ventilation openings, and a solar battery;

applying an optimization criteria to the external air condition index dataset and the internal air condition index dataset, wherein the optimization criteria is based on power efficiency of the solar battery;

determining, responsive to applying the optimization criteria, an air exchange plan wherein the air exchange plan reduces a number of usage cycles the solar battery experiences by controlling the power consumption associated with air exchange in the enclosed space; and performing the air exchange plan by activating, at an optimal time associated with a target air condition and an available remaining charge of the solar battery a HVAC system to perform air exchange and the one or more indicator lights of the one or more ventilation openings, wherein a change of at least one of the one or more indicator lights indicates an optimal time for air exchange for at least one of the one or more ventilation openings.

2. The method of claim 1, further comprising:

predicting an air condition index of the geographical location, wherein predicting the air condition index is based, at least in part, on the external air condition index dataset.

3. The method of claim 1, wherein the optimization criteria is based, at least in part, on an amount of power consumption.

4. The method of claim 1, wherein the optimization criteria is based, at least in part, on maintaining a power bank usage efficiency associated with a solar power system.

5. The method of claim 1, wherein determining the air exchange plan includes:

analyzing the external air condition index dataset and the internal air condition index dataset;

identifying a risk index from the external air condition index dataset and the internal air condition index dataset; and selecting the air exchange plan from a set of air exchange plans, wherein the air exchange plan is selected based on the identified risk index.

6. The method of claim 1, wherein performing the air exchange plan includes:

sending a notification of the one or more notifications to a mobile application, wherein the notification is a message.

7. A system for controlling air conditions in an enclosed space, the system comprising:

a memory; and a processor in communication with the memory, the processor being configured to perform operations comprising:

receiving an external air condition index dataset associated with a geographical location;

receiving, from one or more data collection devices in the enclosed space, an internal air condition index dataset, wherein the enclosed spaces has one or more indicator lights, associated with each of one or more ventilation openings, and a solar battery;

applying an optimization criteria to the external air condition index dataset and the internal air condition index dataset, wherein the optimization criteria is based on power efficiency of the solar battery;

determining, responsive to applying the optimization criteria, an air exchange plan wherein the air exchange plan reduces a number of usage cycles the solar battery experiences by controlling the power consumption associated with air exchange in the enclosed space; and performing the air exchange plan by activating, at an optimal time associated with a target air condition and an available remaining charge of the solar battery a HVAC system to perform air exchange and the one or more indicator lights of the one or more ventilation openings, wherein a change of at least one of the one or more indicator lights indicates an optimal time for air exchange for at least one of the one or more ventilation openings.

8. The system of claim 7, further comprising:

predicting an air condition index of the geographical location, wherein predicting the air condition index is based, at least in part, on the external air condition index dataset.

9. The system of claim 7, wherein the optimization criteria is based, at least in part, on an amount of power consumption.

10. The system of claim 7, wherein the optimization criteria is based, at least in part, on maintaining a power bank usage efficiency associated with a solar power system.

11. The system of claim 7, wherein determining the air exchange plan includes:

analyzing the external air condition index dataset and the internal air condition index dataset;

identifying a risk index from the external air condition index dataset and the internal air condition index dataset; and selecting the air exchange plan from a set of air exchange plans, wherein the air exchange plan is selected based on the identified risk index.

12. The system of claim 7, wherein performing the air exchange plan includes:

sending a notification of the one or more notifications to a mobile application, wherein the notification is a message.

13. A computer program product for controlling air conditions in an enclosed space, the computer program product comprising a computer readable storage medium having program instructions embodied therewith, the program instructions executable by a processor to cause the processors to perform a function, the function comprising:

receiving an external air condition index dataset associated with a geographical location;

receiving, from one or more data collection devices in the enclosed space, an internal air condition index dataset, wherein the enclosed spaces has one or more indicator lights, associated with each of one or more ventilation openings, and a solar battery;

applying an optimization criteria to the external air condition index dataset and the internal air condition index dataset, wherein the optimization criteria is based on power efficiency of the solar battery;

determining, responsive to applying the optimization criteria, an air exchange plan wherein the air exchange plan reduces a number of usage cycles the solar battery experiences by controlling the power consumption associated with air exchange in the enclosed space; and performing the air exchange plan by activating, at an optimal time associated with a target air condition and an available remaining charge of the solar battery a HVAC system to perform air exchange and the one or more indicator lights of the one or more ventilation openings, wherein a change of at least one of the one or more indicator lights indicates an optimal time for air exchange for at least one of the one or more ventilation openings.

14. The computer program product of claim 13, further comprising:

predicting an air condition index of the geographical location, wherein predicting the air condition index is based, at least in part, on the external air condition index dataset.

15. The computer program product of claim 13, wherein the optimization criteria is based, at least in part, on an amount of power consumption.

16. The computer program product of claim 13, wherein determining the air exchange plan includes:

analyzing the external air condition index dataset and the internal air condition index dataset;

identifying that a risk index from the external air condition index dataset and the internal air condition index dataset; and selecting the air exchange plan from a set of air exchange plans, wherein the air exchange plan is selected based on the identified risk index.

17. The computer program product of claim 13, wherein performing the air exchange plan includes:

sending a notification of the one or more notifications to a mobile application, wherein the notification is a message.

18. The computer program product of claim 13, wherein the optimization criteria is based, at least in part, on maintaining a power bank usage efficiency associated with a solar power system.

* * * * *